US006474120B1

(12) United States Patent
Wadsworth et al.

(10) Patent No.: US 6,474,120 B1
(45) Date of Patent: Nov. 5, 2002

(54) BOLT ASSEMBLY

(75) Inventors: Martin James Wadsworth, Atherton (GB); Stephen Leslie Foster, Blackburn (GB)

(73) Assignee: EJA Engineering Limited, Wigan (GB)

( * ) Notice: Subject to any disclaimer, the term of this patent is extended or adjusted under 35 U.S.C. 154(b) by 0 days.

(21) Appl. No.: 09/381,821

(22) PCT Filed: Feb. 24, 1999

(86) PCT No.: PCT/GB99/00568

§ 371 (c)(1),
(2), (4) Date: Dec. 23, 1999

(87) PCT Pub. No.: WO99/43915

PCT Pub. Date: Sep. 2, 1999

(51) Int. Cl.[7] ..... E05B 47/00
(52) U.S. Cl. ..... 70/276; 70/99; 292/251.5
(58) Field of Search ..... 70/276–283, 99, 70/100; 292/251.5

(56) References Cited

U.S. PATENT DOCUMENTS 5,699,686 A * 12/1997 Neumayer et al. ..... 70/276 X 5,823,026 A * 10/1998 Finke ..... 70/276

* cited by examiner

*Primary Examiner*—Suzanne Dino Barrett
(74) *Attorney, Agent, or Firm*—William R. Walbrun

(57) ABSTRACT

A bolt assembly for interengaging two relatively movable elements. The assembly comprises a first component (1) which is connected to one element, and a second component (11) which is connected to the other element. The first component (1) includes a bolt (4) displaceable between engaged and disengaged positions, and the second component (11) comprises means for engaging the bolt to interengage the elements to which the components (1, 11) are connected when the first component is in a predetermined position relative to the second component and the bolt (4) is in the engaged position. The first component (1) comprises a magnetically (3) releasable latch mechanism arranged to latch the bolt (4) in the disengaged position, and the second component (11) comprises at least one source of magnetic flux (12) arranged to release the latch when the first component (1) is in the predetermined position relative to the second component (11).

17 Claims, 6 Drawing Sheets

BOLT ASSEMBLY

The present invention relates to a bolt assembly for interengaging two relatively movable elements.

Interlock bolt systems are well known which are intended to prevent access to the interior of for example a machine enclosure unless the bolt assemblies are disengaged after the enclosed machine has been de-energised, or to prevent the doors of for example a railway vehicle from being opened unless the bolt assemblies have been disengaged after the vehicle is stationary. The known bolt assemblies comprise two components one of which is connected to one element of an enclosure such as a door frame and the other of which is connected to another element of the enclosure, for example a door. The first component includes a bolt displaceable between engaged and disengaged positions, and the second component comprises a socket into which the bolt may be extended when the two components are in an appropriate position relative to each other and the bolt is moved to the engaged position. The position of the bolt is controlled for example by manipulation of a security key or energisation of an interlock circuit so as to prevent opening of the enclosure except in predetermined safe conditions.

It is known to provide bolt assemblies which are operated by keys, the operating keys being trapped by the key operated mechanism unless the associated components of the bolt assembly are in a predetermined configuration in which it is assumed the components are locked together. For example, in a bolt assembly for a machine enclosure, the same key may be used to control both machine energisation and bolt position. The key is trapped in the bolt assembly unless the bolt has been extended, the expectation being that if the bolt is extended the enclosure door is locked shut. Once the door has been locked, the key can be removed from the bolt assembly and used to energise the machine. One of the problems with such bolt assemblies is that, if a key is actuated to extend the bolt in circumstances where it is presumed that the two components of the bolt assembly are interengaged by the bolt but in fact the two components are not interengaged, unsafe conditions may prevail despite the bolt being extended. It will of course be appreciated that in a two component bolt assembly it is not sufficient to ensure simply that the bolt is extended as it may be that the bolt when extended has not engaged the other component of the assembly. Similar problems can arise with for example vehicle doors, where it is not sufficient to sense only bolt extension to check whether or not a door has been locked shut. It is also necessary to be sure that the door is shut so as to be engaged by the extended bolt.

In one known interlocked bolt assembly, a first component of the assembly carries a key actuated lock mechanism and the second component of the assembly carries a bolt or catch. The key is retained in the first component unless it has been turned to a key-release position. The key is prevented from being turned to the key-release position unless the bolt or catch has been extended from the second component into engagement with the first component. Such an arrangement functions satisfactorily, but each of the two components supports a relatively complex mechanism which in some applications is inconvenient. Furthermore, it is difficult to provide an emergency release function, enabling persons trapped within an enclosure to exit the enclosure without use of the keys.

It is an object of the present invention to obviate or mitigate the problems outlined above.

According to the present invention, there is provided a bolt assembly for interengaging two relatively moveable elements, the assembly comprising a first component which in use is connected to one element, and a second component which in use is connected to the other element, the first component including a bolt displaceable between engaged and disengaged positions, and the second component comprising means for engaging the bolt to interengage elements to which the components are connected when the first component is in a predetermined position relative to the second component and the bolt is in the engaged position, wherein the first component comprises a magnetically releasable latch mechanism arranged to latch the bolt in the disengaged position, and the second component comprises at least one source of magnetic flux arranged to release the latch when the first component is in the predetermined position relative to the second component.

The magnetically releasable latch mechanism may comprise one or more permanent magnets biased to a latch engaging position and the magnetic means may comprise one or more permanent magnets arranged to displace the or each permanent magnet of the latch mechanism to a latch releasing position when the first component is in the predetermined position relative to the second component. For example, two parallel bar magnets may be provided in the first component and two permanent bar magnets may be provided in the second component, the permanent magnets of each component being of the same polarity such that the permanent magnets of the first component can only be displaced by exposure to magnetic fields generated by two further permanent magnets or sources of magnetic flux producing an equivalent magnetic field to two permanent magnets. This makes it difficult for the latch mechanism to be released in an unauthorised manner.

The at least one permanent magnet of the latch mechanism may be biased to the latch engaging position by a spring or a further permanent magnet. The bolt and the or each permanent magnet may each define slots and a locking member may be located between the bolt and the or each permanent magnet so as to engage either in the bolt slot or in the adjacent magnet slot. If the locking member is engaged in the magnet slot, the bolt is free to move between engaged and disengaged positions. If the locking member is engaged in the bolt slot, the bolt is retained in the. disengaged position.

The bolt may comprise a cylindrical member slidably received in a cylindrical bore. Alternatively, one or more pivotally mounted locking arms may be provided, one end of the or each locking arm defining a bolt. The pivotally mounted arm may be mechanically coupled to a solenoid energisable to pivot the locking arm and a switch may be provided for sensing the pivotal position of the locking arm.

Embodiments of the present invention will now be described, by way of example, with reference to the accompanying drawings, in which.

Figure 4:
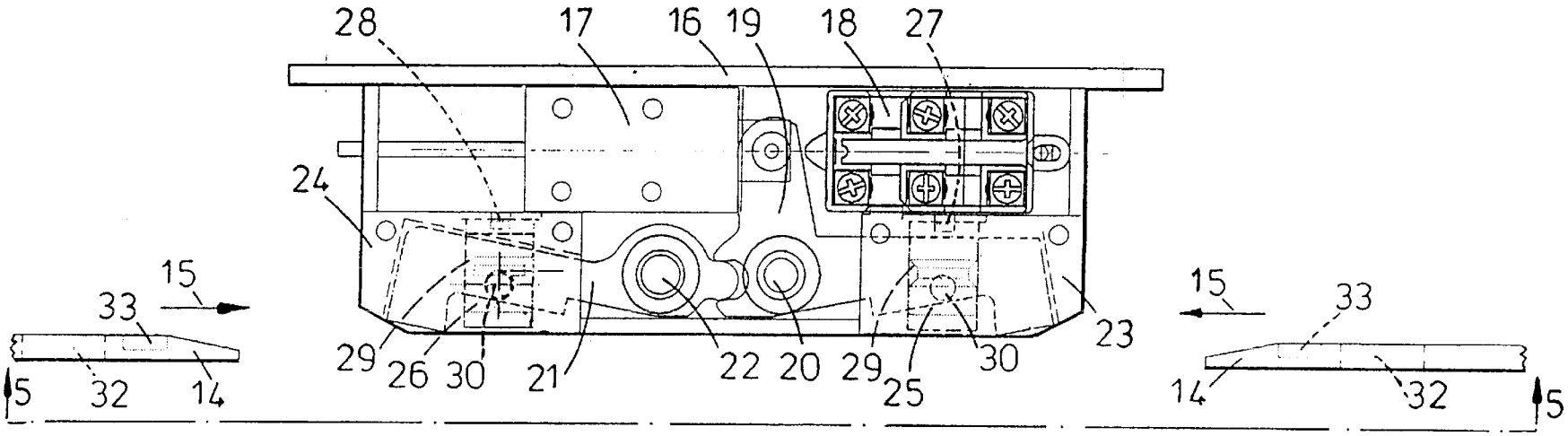
FIG. 4 illustrates the mechanism of a second embodiment of the invention which may be installed in a railway vehicle door latch mechanism.
Figure 5:
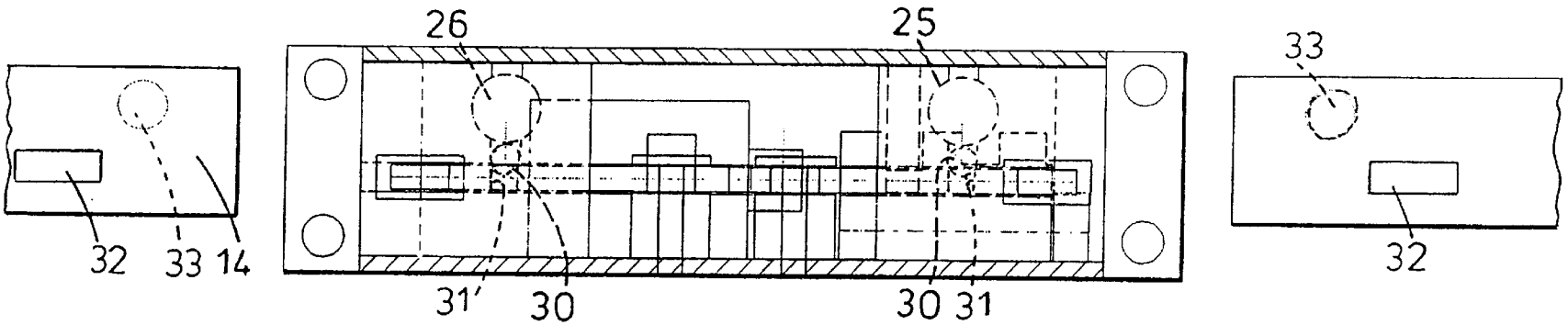
FIG. 5 is a view in the direction of arrows 5—5 of FIG. 4 of the second embodiment.
Figure 6:
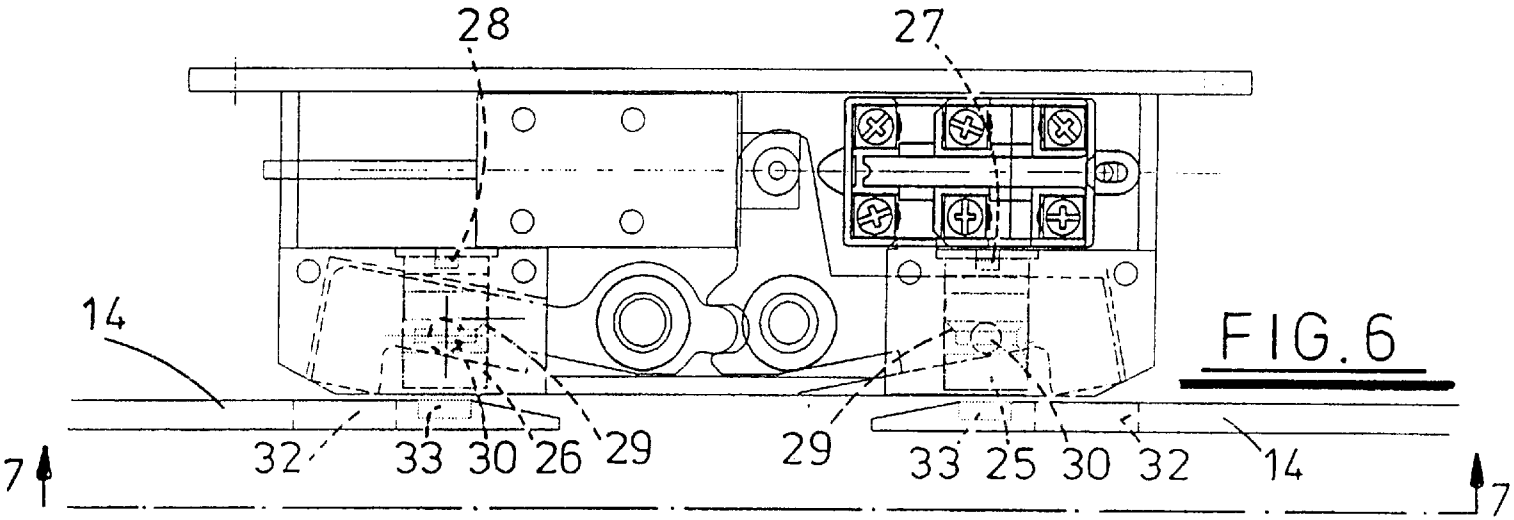
Figure 7:
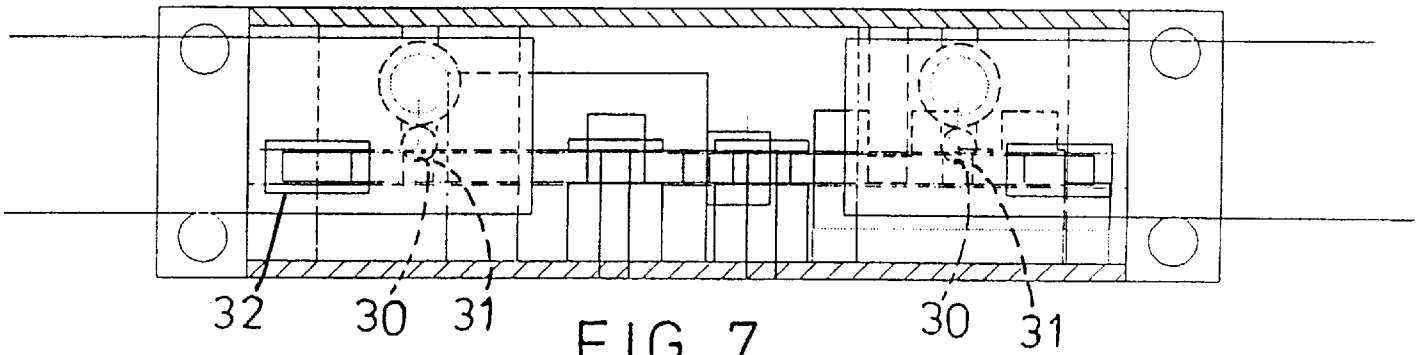
Figure 8:
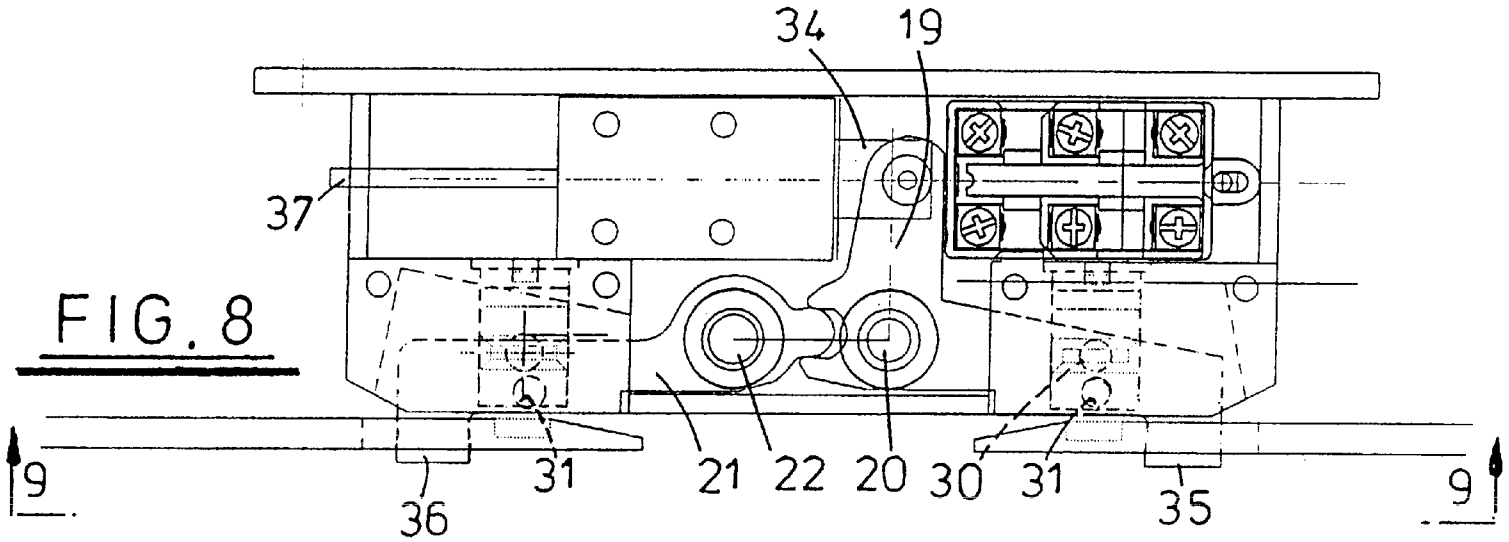
Figure 9:
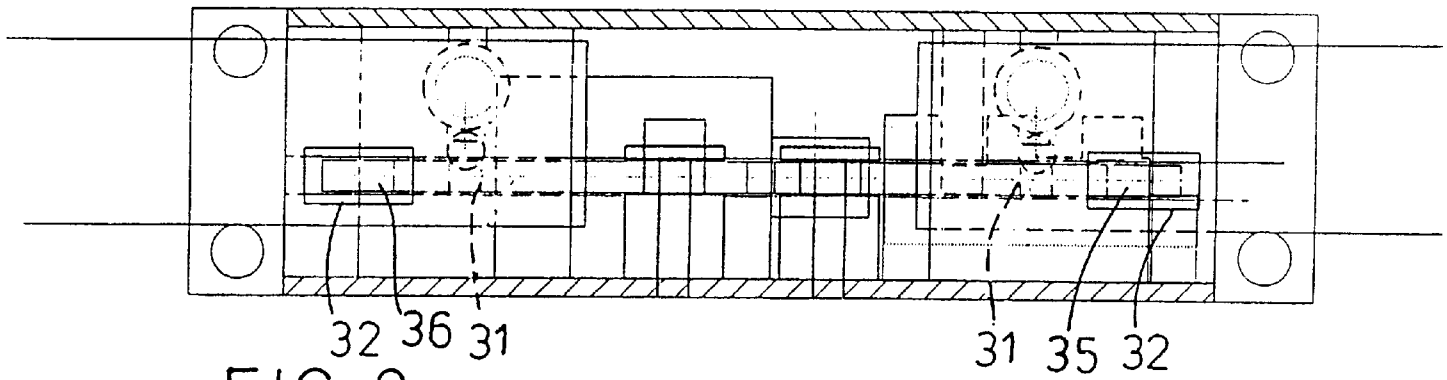

FIGS. 6 and 7 are views equivalent to FIGS. 4 and 5 respectively after closure of the railway vehicle doors; and FIGS. 8 and 9 are views similar to FIGS. 6 and 7 after the closed railway vehicle doors have been locked in the closed configurations.

Figure 1:
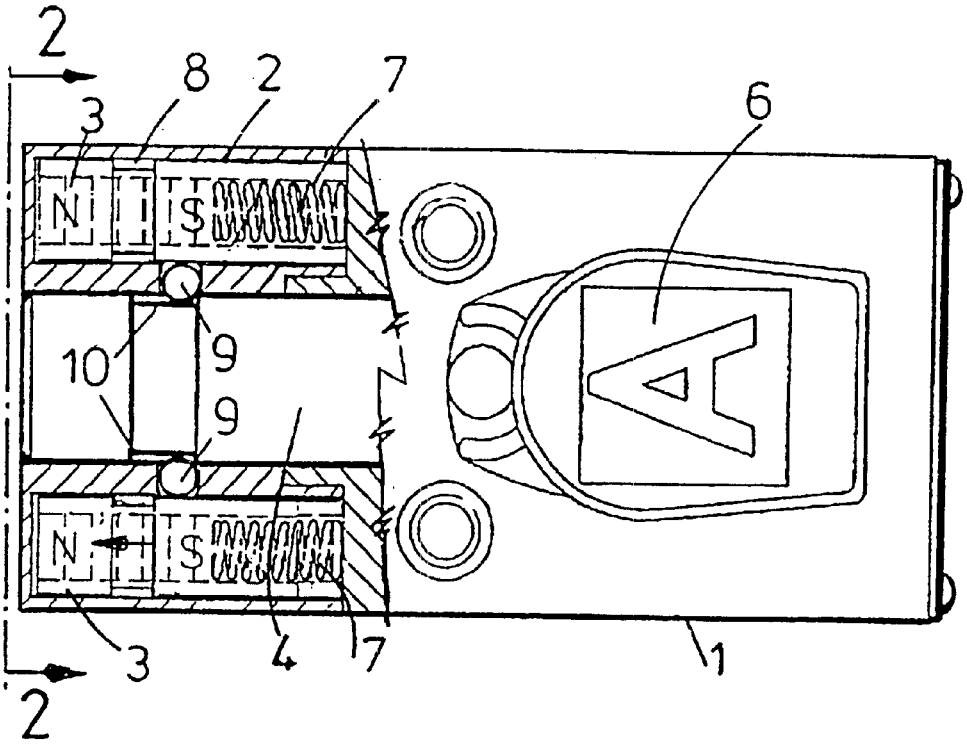
FIG. 1 is a partially cut away view of one component of an embodiment of the present invention with a bolt which forms part of that component in a disengaged retracted position.
Figure 2:
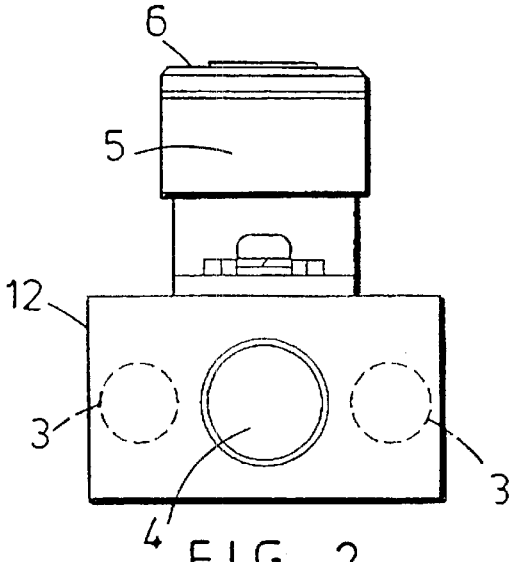
FIG. 2 is an end view in the direction of arrows 2—2 of the assembly component shown in FIG. 1.
Figure 3:
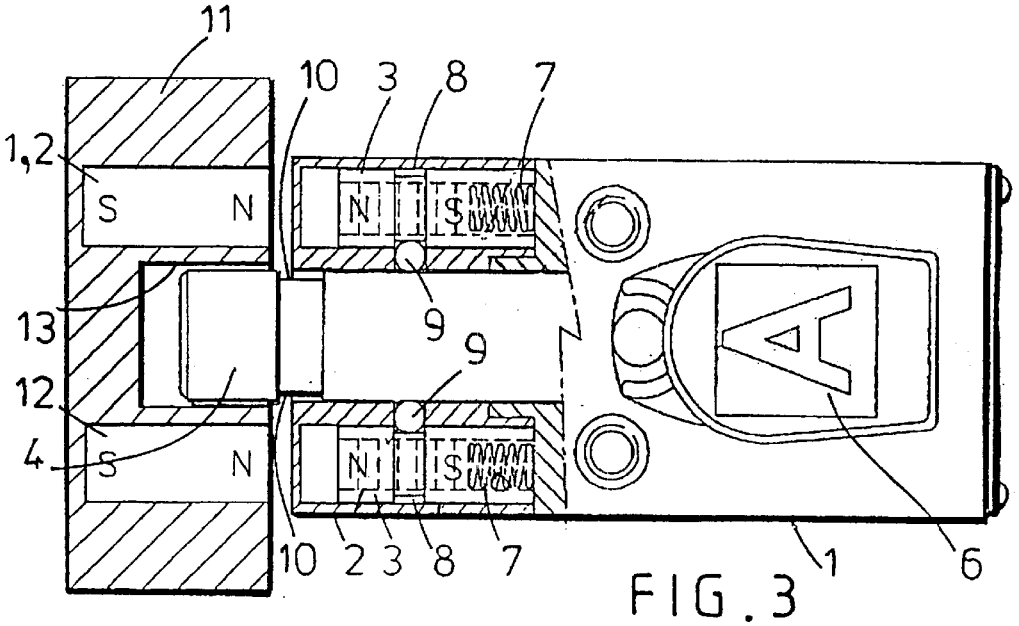
FIG. 3 is a partially cutaway view of the component of FIG. 1 after it has been moved into a position in which it engages a second component of the assembly.

Referring to FIGS. 1 to 3 of the accompanying drawings, the illustrated bolt assembly comprises a first component comprising a body 1 an end section 2 of which slidably receives a pair of permanent bar magnets 3 and a locking bolt 4. The axial position of the locking bolt 4 can be controlled by a key (not shown) which can be inserted into a locking key mechanism 5 the upper surface of which is covered by a cover plate 6 which in the illustrated example carries the symbol A. In a practical application, a key also carrying the symbol A would be provided to enable axial displacement of the bolt 4. The means by which the rotation of a key inserted into the key mechanism 5 would cause axial displacement of the bolt 4 is not directly relevant to the present invention but it will be appreciated that many mechanical arrangements would be possible, for example rotation of a key in the key mechanism 5 could cause rotation of a pin engaged in a helical slot (not shown) in the bolt 4 so as to control the axial position of the bolt.

Each of the two bar magnets 3 is received within a cylindrical bore and is biased against the left hand end of that bore (as seen in FIG. 1) by a respective spring 7. The permanent magnets each define a recess in the form of a slot 8 which in the position shown in FIG. 1 is axially displaced relative to a locking member in the form of a ball 9. In the position of the components shown in FIG. 1, the balls 9 are engaged in a recess defined by a circumferential slot 10 provided in the bolt 4. With the components in the positions shown in FIG. 1 the bolt 4 cannot be extended out of the body end section 2 as a result of interengagement between the balls 9 and the slot 10.

Referring to FIG. 3, the bolt assembly comprises a second component 11 in which two bar magnets 12 are located. As shown in FIG. 3, the polarities of the bar magnets 12 are the same, and opposed to the polarities of the bar magnets 3. Thus when the bar magnets 12 are aligned with the bar magnets 3, the bar magnets 3 are repelled by the bar magnets 12, compressing springs 7 until the bar magnets 3 assume the positions shown in FIG. 3. The locking balls 9 are then free to move into the slots 8 in the bar magnets 3. With the bar magnets 3 in the position shown in FIG. 3, actuation of a key in the key assembly can cause the bolt 4 to be extended out of the body end section 2 into engagement with a socket 13 defined by the second bolt assembly component 11.

Thus if the body 1, 2 is mounted on for example a machine enclosure door frame and the component 11 is mounted on a machine enclosure door, the door can be locked in a closed condition by arranging the components as shown in FIG. 3. To open the door, it is necessary to retract the bolt 4 by inserting an appropriate key. Once the bolt 4 has been retracted, the door can be opened, moving the permanent magnets 3 away from the permanent magnets 12 and causing the permanent magnets 3 to move to the left in FIG. 3 under the influence of the spring 7. This will force the locking balls 9 into engagement with the slot 10, preventing subsequent extension of the bolt 4 unless the components of the assembly shown in FIG. 1 are returned to the position relative to the component 11 of FIG. 3 as shown in FIG. 3.

It would be possible to displace the permanent magnets 3 to the position shown in FIG. 3 by holding two bar magnets with appropriate polarity against the end section 2 of the body of the first component. Given that the magnets are arranged to repel each other, the magnets would have to be held in place as the key was operated, for example by holding the magnets in position using adhesive tape. This could be done but such unauthorised activity would be difficult to conceal. Thus it is unlikely that in normal circumstances a machine operator would override the interlock mechanism.

With a structure such as that illustrated in FIGS. 1 to 3, it would be a relatively easy matter to provide an electrical output indicative of the status of the magnetically disengageable latch mechanism. For example a magnetically responsive reed switch could be positioned adjacent the permanent magnets 3 so as to provide an output indicative of the position of the permanent magnets relative to the body. Such an output could be used to provide a remote indication of the bolt assembly status or to provide a control input to associated apparatus.

The operation of the bolt may be achieved by mechanical, electromechanical or pneumatic/hydraulic means, should the application be integrated into other equipment such as automatic sliding doors found in trains for example. Such an example is illustrated in FIGS. 4 to 9.

Referring now to FIGS. 4 to 9, FIGS. 4 and 5 show the mechanism before the doors have been closed, FIGS. 6 and 7 show the mechanism after the doors have been closed but not locked in the closed position, and FIGS. 8 and 9 show the mechanism after the doors have been closed and locked.

Referring to FIGS. 4 and 5, plates 14 are mounted on respective sliding doors (not shown) of a railway vehicle, the doors being slidable towards each other in the direction of arrows 15 to a closed position. The plates 14 are slidable in front of a locking mechanism mounted on a back plate 16 which is secured to a frame of the vehicle door. The back plate 16 supports a housing which receives a solenoid 17, a switch unit 18, and a bolt mechanism comprising a first locking arm 19 pivotal about a pin 20 and a second locking arm 21 pivotal about a pin 22. The ends of the arms 19 and 21 remote from the pivots 20 and 22 are received in slots defined by body members 23 and 24. Shuttles 25 and 26 each of which incorporates a permanent magnet are received in bores defined in the body members 23 and 24. A small permanent magnet 27 is arranged adjacent one end of the shuttle 25 so as to cause the shuttle to move in the upwards direction as shown in FIG. 4. Similarly, a small permanent magnet 28 is arranged adjacent the shuttle 26 so as to normally bias the shuttle 26 in the upwards direction as shown in FIG. 4.

In the configuration shown in FIGS. 4 and 5, the locking arms 19 and 21 are retracted inside the body members 23 and 24 and therefore do not obstruct movement of the plates 14 past the locking arm assembly.

The shuttles 25 and 26 are generally cylindrical but recesses defined by grooves 29 are formed midway along the lengths of the shuttles. Locking balls 30 are supported in the body members 23 and 24 and engage in recesses 31 defined in the locking arms. The locking arms are thus latched in the position as shown in FIGS. 4 and 5 and cannot move from those positions as a result of interengagement between the balls 30 and the recesses 31. The balls 30 are not aligned with the grooves 29 in the shuttles 25 and 26 and therefore are prevented from moving out of engagement with the recesses 31.

Referring now to FIGS. 6 and 7, this shows the configuration of the locking assembly after the vehicle doors have been closed and as a result the plates 14 which are carried by the doors have moved such that apertures 32 defined in the plates 14 are aligned with the ends of the locking arms 19 and 21 remote from the pivots 20 and 22. In addition, permanent magnets 33 carried by the plate 14 are axially aligned with the shuttles 25 and 26. As a result, the shuttles 25 and 26 are pulled by magnetic attraction towards the magnets 33 and away from the magnets 27 and 28. This aligns the grooves 29 with the recesses 31, which means that the balls 30 are free to move out of engagement with the recesses 31. As shown in FIGS. 6 and 7, the balls 30 are still engaged in the recesses 31 but it will be appreciated that the locking arms 19 and 21 could be displaced from the position shown in FIGS. 6 and 7 as such movement would simply push the balls 30 out of engagement with the recesses 31 into the grooves 29.

FIGS. 8 and 9 show the assembly after extension of a plunger 34 of the solenoid 17. This causes the locking arm 19 to pivot in the clockwise direction as shown in FIG. 8 and the locking arm 21 to pivot in the anti-clockwise direction as shown in FIG. 8. The ends of the locking arms remote from the pivots 20 and 22 support bolts 35, 36 which are extended through the openings 32 in the plates 14 as a result of the pivotal movement of the arms 19, 21. The bolts 35, 36 thus lock the vehicle doors in the closed position. The only way the doors can be opened is by retracting the plunger 34 of the solenoid 17, either by energising the solenoid to compresses a spring (not shown) arranged to normally extend the plunger 34, or by pulling on an emergency override pin 37 which is connected to a manual release line (not shown).

In the embodiment of FIGS. 4 to 9, the locking balls 30 are arranged to engage in recesses 31 defined by bores extending through the locking arms 19, 21. The recesses 31 could be defined by indentations in the surfaces of the locking arms rather than by bores extending through the locking arms. In addition, the locking balls 30 could be replaced by latching arms pivotal by engagement with the shuttles 25, 26 between latched positions in which ends of the latching arms are engaged in the recesses 31 and released positions in which the ends of the latching arms are received in the grooves 29. It is believed that pivotal latching arms are less likely to jam in the recesses 31 than spherical locking balls.

What is claimed is:

1. A bolt assembly for interengaging two relatively movable elements, the assembly comprising a first component which in use is connected to one element, and a second component which in use is connected to the other element, the first component including a bolt displaceable between engaged and disengaged positions, and the second component comprising means for engaging the bolt to interengage elements to which the components are connected when the first component is in a predetermined position relative to the second component and the bolt is in the engaged position, wherein the first component comprises a magnetically releasable latch mechanism arranged to latch the bolt in a disengaged position, and the second component comprises at least one source of magnetic flux arranged to release the latch when the first component is in the predetermined position relative to the second component, the magnetically releasable latch mechanism having at least one permanent magnet slidably mounted for non-pivotal reciprocating longitudinal movement between a biased latch engaging position and a latch releasing position in a common direction of movement of the bolt, and the at least one source of magnetic flux including at least one permanent magnet arranged to displace the permanent magnet of the latch mechanism to the latch releasing position when the first component is in the predetermined position relative to the second component.

2. A bolt assembly according to claim 1, wherein the magnetically releasable latch mechanism comprises two permanent magnets each biased to a latch engaging position and the magnetic means comprises two permanent magnets each arranged to displace a respective permanent magnet of the latch mechanism to a latch releasing position.

3. A bolt assembly according to claim 2, wherein the permanent magnets of the releasable latch mechanism are bar magnets arranged parallel to each other with the same polarity, and the permanent magnets of the magnetic means are bar magnets arranged parallel to each other with the same polarity.

4. A bolt assembly according to claim 3, wherein the bar magnets of the first component are arranged to repel the bar magnets of the second component.

5. A bolt assembly according to claim 1, wherein the said at least one permanent magnet of the latch mechanism is biased to the latch engaging position by a spring.

6. A bolt assembly according to claim 1, wherein the said at least one permanent magnet of the latch mechanism is biased to the latch engaging means by a further permanent magnet.

7. A bolt assembly according to claim 1, wherein the permanent magnet of the magnetically releasably latch and the bolt each define a recess, and a locking member is provided between the bolt and the permanent magnet such that the locking member is engageable either in the bolt recess when the bolt is in the disengaged position and the latch is engaged or in the permanent magnet recess when the bolt is the engaged position and the latch is released.

8. A bolt assembly according to claim 7, wherein the bolt comprises a cylindrical member slidably received in a cylindrical bore.

9. A bolt assembly according to claim 7, comprising at least one pivotally mounted locking arm one end of which defines a bolt.

10. A bolt assembly according to claim 9, wherein the pivotally mounted arm is mechanically coupled to a solenoid energisable to pivot the locking arm.

11. A bolt assembly according to claim 10, comprising a switch for sensing the pivotal position of the locking arm.

12. A bolt assembly for interengaging two relatively movable elements, the assembly comprising a first component which in use is connected to one element, and a second component which in use is connected to the other element, the first component including a bolt displaceable between engaged and disengaged positions, and the second component having a socket to engage the bolt to interengage elements to which the components are connected when the first component is in a predetermined position relative to the second component and the bolt is in the engaged position, wherein the first component comprises a magnetically releasable latch mechanism having at least one magnetically movable member slidably mounted for non-pivotal reciprocating longitudinal movement between a biased latch engaging position and a latch releasing position in a common direction of movement of the bolt, the magnetically releasable latch mechanism having a locking member movable between a first position to latch the bolt in a disengaged position and to a second position when the bolt is in an engaged position, and the second component including at least one permanent magnet arranged to displace the permanent magnet of the latch mechanism to the latch releasing position when the first component is in the predetermined position relative to the second component.

13. The bolt assembly of claim 12, wherein the locking member is a locking ball.

14. The bolt assembly of claim 12, wherein the at least one magnetically movable member is a permanent magnet.

15. The bolt assembly of claim 12, wherein the at least one magnetically movable member is a shuttle having at least one permanent magnet positioned adjacent to the shuttle to move the shuttle by magnetic attraction.

16. A bolt assembly for interengaging two relatively movable elements, the assembly comprising a first component which in use is connected to one element, and a second component which in use is connected to the other element, the first component including a locking arm pivotally mounted at a pivot, the locking arm having an end portion remote from the pivot forming a bolt, the bolt being displaceable between engaged and disengaged positions, and the second component having a socket to engage the bolt to interengage elements to which the components are connected when the first component is in a predetermined position relative to the second component and the bolt is in the engaged position, wherein the first component includes a magnetically releasable latch mechanism having at least one shuttle slidably mounted for non-pivotal reciprocating longitudinal movement in a direction perpendicular to the second component between a biased latch engaging position and a latch releasing position in a common direction of movement of the bolt, the at least one shuttle being positioned immediately adjacent to the locking arm, the magnetically releasable latch mechanism having a locking member movable between a first position to latch the bolt in a disengaged position and to a second position when the bolt is in an engaged position, and the second component including at least one permanent magnet arranged to displace the permanent magnet of the latch mechanism to the latch releasing position when the first component is in the predetermined position relative to the second component.

17. The bolt assembly of claim 16, wherein the locking member is a locking ball.

* * * * *